US006881241B2

(12) United States Patent
Fuerst et al.

(10) Patent No.: US 6,881,241 B2
(45) Date of Patent: Apr. 19, 2005

(54) METHOD FOR MANUFACTURING CLOSED-WALL CELLULAR METAL

(75) Inventors: Carlton Dwight Fuerst, Royal Oak, MI (US); Sheila Farrokhalaee Kia, Bloomfield Hills, MI (US); Thomas C. Pederson, Rochester Hills, MI (US)

(73) Assignee: General Motors Corporation, Detroit, MI (US)

( * ) Notice: Subject to any disclaimer, the term of this patent is extended or adjusted under 35 U.S.C. 154(b) by 165 days.

(21) Appl. No.: 10/298,785

(22) Filed: Nov. 18, 2002

(65) Prior Publication Data

US 2004/0093987 A1 May 20, 2004

(51) Int. Cl.[7] ..... B22D 27/00
(52) U.S. Cl. ..... 75/415
(58) Field of Search ..... 75/415; 164/79; 427/244

(56) References Cited

U.S. PATENT DOCUMENTS

| | | | | |
|---|---|---|---|---|
| 4,314,835 A | * | 2/1982 | Pelton | 164/79 |
| 4,973,358 A | | 11/1990 | Jin et al. | 75/415 |
| 5,112,697 A | | 5/1992 | Jin et al. | 428/613 |
| 5,334,236 A | | 8/1994 | Sang et al. | 75/415 |

* cited by examiner

*Primary Examiner*—Melvyn Andrews
(74) *Attorney, Agent, or Firm*—Kathryn A. Marra

(57) ABSTRACT

Cellular metal foam having closed cell walls is produced by introducing gas bubbles of suitable size and at a suitable rate below the surface of an otherwise non-stirred or non-agitated molten metal bath. For example, aluminum-silicon alloy, including silicon carbide foam stabilization particles has been thus processed into cellular metal of, as low as, one to two percent relative density and with good cell walls and quite regular cell size.

10 Claims, 1 Drawing Sheet

METHOD FOR MANUFACTURING CLOSED-WALL CELLULAR METAL

TECHNICAL FIELD

This invention pertains to making cellular metal structures having generally uniform cell walls and cell sizes. More specifically, this invention pertains to a quiescent gas bubble injection method of making such closed cell cellular metals.

BACKGROUND OF THE INVENTION

Man made cellular solids often have useful strength to weight ratios and find applications as load bearing or energy absorbing products. Cellular metals are usually called metal foams. They consist of a network of interconnected solid struts or plates that form the edges and faces of cells. They can take the form of a honeycomb, open cell foam or closed cell foam.

Honeycombs consist of a two-dimensional array of polygons expanded in one preferential direction. The cells of the honeycomb are usually open in the preferred direction but the polygonal walls close the structure in other directions. Open cell foams consist of a network of open struts connected to one another with no cell walls. Open cell foams are made of cell edges only and they have an "open" structure through which a fluid could flow. Closed cell foams have cell walls that are continuous. The space within the cell walls is totally enclosed, containing only air or gases but there is no open passage between cells.

Closed cell metal foams with their empty cells and structural walls offer a very useful combination of reduced weight and strength. Ideally, they could be formed as an assembly of uniformly shaped and sized polyhedrons. According to engineering analysis such idealized metal foams would provide excellent strength and energy absorbing properties. But it has proven very difficult in practice to manufacture such geometrically regular cellular metal structures.

U.S. Pat. Nos. 4,973,358; 5,112,697 and 5,334,236, each assigned to Alcan International Limited of Montreal, Canada, describe methods and apparatus for making lightweight, closed cell foamed metal slabs. These disclosures describe a practice applied to aluminum alloy A356 containing, for example, 15 volume percent, finely divided (e.g., 0.1 to 100 $\mu$m in largest dimension) solid particles, such as silicon carbide particles, that are required for forming a stabilized foam. Air bubbles were discharged beneath the surface of the molten composite-alloy to produce a closed cell foam of the composite particulate/aluminum alloy material.

Foaming was accomplished using a movable air injection shaft into the liquid at an angle of, e.g., 30° to 45° to the horizontal surface. Several examples of foaming gas introduction using rotating or reciprocating gas injection shafts are described, especially in U.S. Pat. No. 5,334,236. The air or gas injection caused foaming of the molten composite above the point of gas discharge and agitation. The stabilized foam was removed in solid form from the surface of the molten composite. The foam was described as having cell size that was controlled by adjusting the air flow rate, the number of nozzles used in air injection, the nozzle size, the nozzle shape and the impeller rotational speed.

Aluminum foams of various densities produced by the described process are available from Cymat Aluminum Corporation of Mississagua, Ontario. However, Cymat foams have not been characterized by uniform cell structure. Purchased foams have the surface appearance of FIG. 10 of U.S. Pat. No. 5,334,236, but they have a defect-riddled porous structure. They are more like low-density porous metals than true cellular metal foams.

It is an object of this invention to provide a process of making a closed cell metal foam having a cross section characterized by a regularity of uniform cells with smooth concave walls that intersect at clearly defined boundaries.

SUMMARY OF THE INVENTION

This invention utilizes gas bubbles, such as air or other gas bubbles, to generate a closed cell foam from a composite melt of a relatively low melting aluminum-silicon alloy infused with up to about twenty percent by weight of silicon carbide particles or the like. One or more streams of gas bubbles are released from a suitable stationery outlet below the surface of the melt. The pressure of the gas and size of the gas outlet are such that individual gas bubbles enter the melt below the surface. The gas bubbles are suitably introduced through tubes or porous plates having outlets with a diameter or effective diameter of 0.0001 inch (25 microns) to 0.1 inch (25,000 microns). Gas pressures up to about 100 psig have been used to produce gas flows in the range of 1 cc/min to 100 cc/min at an individual outlet. The gas release is a quiescent process. The bubbles are released without stirring or agitation of the stream apart from the action of the individual bubbles. In the absence of added turbulence, the bubbles rise vertically above the spot of their introduction to produce a body of foam in that narrow region of the melt.

When it is desired to form a wider body of foam, additional distinct gas bubble sources are provided. The combined effect of the multiple, unstirred bubble streams produces a merged foam body that hardens and strengthens upon cooling at the surface of the melt. The cooled portion of the foam product is withdrawn from the melt at the rate that new, underlying foam is being generated by the bubbles. The solidified withdrawn cellular product has a surprisingly uniform cell structure. Furthermore, such a uniform cell structure can be retained even when producing very low density foams—foams having a density of, for example, only one to two percent of the density of the aluminum alloy/particulate composite of which the foam is made.

Cellular metal bodies produced by the process of this invention have a more uniform cell size and wall structure than cellular metals made using mechanical agitation as the bath is sparged with air or other gas. This uniformity of structure provides significant improvements in the energy adsorbing properties of the metal foams.

A parameter that is of primary significance in determining the properties of a cellular solid is its relative density. Relative density is the ratio of the density of the cellular solid to the density of the solid material from which the cellular solid is made. The process permits very low-density cellular products to be made. Aluminum-silicon eutectic alloys with suspended silicon carbide particles have been converted into cellular columns having a relative density of, for example, only one to two percent. The low-density cellular bodies have uniform wall structures with smooth concave walls that intersect at clearly defined boundaries. These cellular metals display a surprisingly high level of energy adsorption capability. In other words the uniform cell structure permits a block or column of the cellular material to adsorb a high energy impact before crushing. They are capable of excellent isotropic energy absorption and stiffening.

In contrast, cellular bodies of the same material made using mechanical agitation of the bath during gas injection have defect riddled porous structures. They lack regularity of uniform cells with smooth concave walls that intersect at clearly defined boundaries. Even when produced in relatively low densities they behave in physical testing more like heavier porous materials than true cellular structures.

Other objects and advantages of the invention will become more apparent from a description of the following preferred embodiments.

DESCRIPTION OF A PREFERRED EMBODIMENT

Metal foams have been made of suitable alloys of, for example, aluminum, copper, lead, magnesium, nickel, steel and zinc. Often the alloy to be foamed is a composite containing finely divided solid refractory, foam stabilizer particles. Examples of such stabilizer materials include alumina, magnesium oxide, silicon carbide, silicon nitride, titanium diboride, zirconia, and the like. In these composite foamable materials the volume fraction of particles is usually less than 25% and is preferably in the range of about 5 to 15%. The foam stabilizer particles are generally substantially equiaxial with sizes generally in the range of about 0.5 $\mu$m to about 20 $\mu$m.

Sometimes the alloy is prepared to contain thermally decomposable particles that release a foaming gas when the alloy is melted and heated to a suitable foaming temperature. More often a foam-forming gas is injected into the molten metal to produce the foam. Air is often used when it is chemically compatible with the product to be produced. Other foaming gases include nitrogen, carbon dioxide, argon, and the like.

Aluminum-silicon alloys such as AA356 have properties suitable for potential use as energy absorbers in automotive vehicles. The nominal composition of AA356 is, by weight, 8.50 to 9.50% silicon with limited amounts of iron, copper, magnesium, nickel and titanium, and the balance aluminum. This alloy infused with 20 percent by weight silicon carbide particles is commercially available as Duralcan FS20 (a trademark of Alcan Corporation). The practice of the invention will be illustrated using this material.

Figure 1:
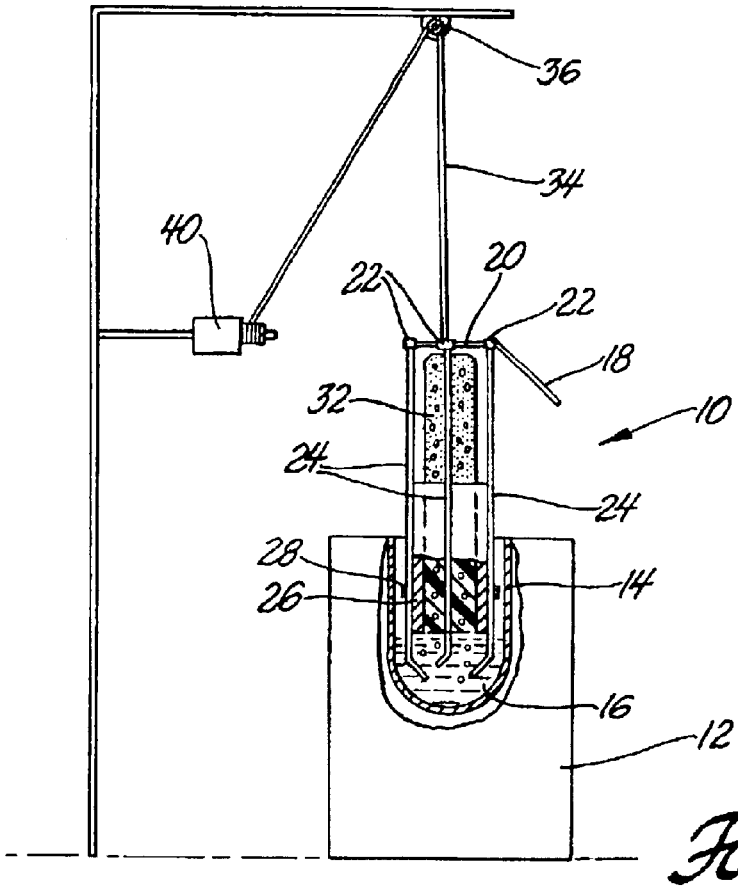
FIG. 1 is a schematic illustration of apparatus for producing closed cell metal foam in accordance with this invention.

Foam making apparatus is indicated at 10 in FIG. 1. The apparatus includes electrical resistance heated furnace 12 with a round open top. Fitted into the open top of furnace 12 is a ceramic crucible 14 containing Duralcan FS20 molten aluminum-silicon alloy with solid stabilizer particles 16. The furnace is controlled to maintain a melt temperature of about 650° C.

Argon gas from tank storage, not shown, enters gas supply tube 18 at a controlled pressure of, e.g., 50 psig. From supply tube 18 the argon enters tubular manifold 20 in which it is distributed through T-shaped connectors 22 to four equispaced stainless steel tubes, each 24, for delivery beneath the surface of the molten aluminum 16. See FIGS. 1 and 2. The steel tubes suitably have diameters in the range of about 0.007 inch to 0.02 inch.

Figure 2:
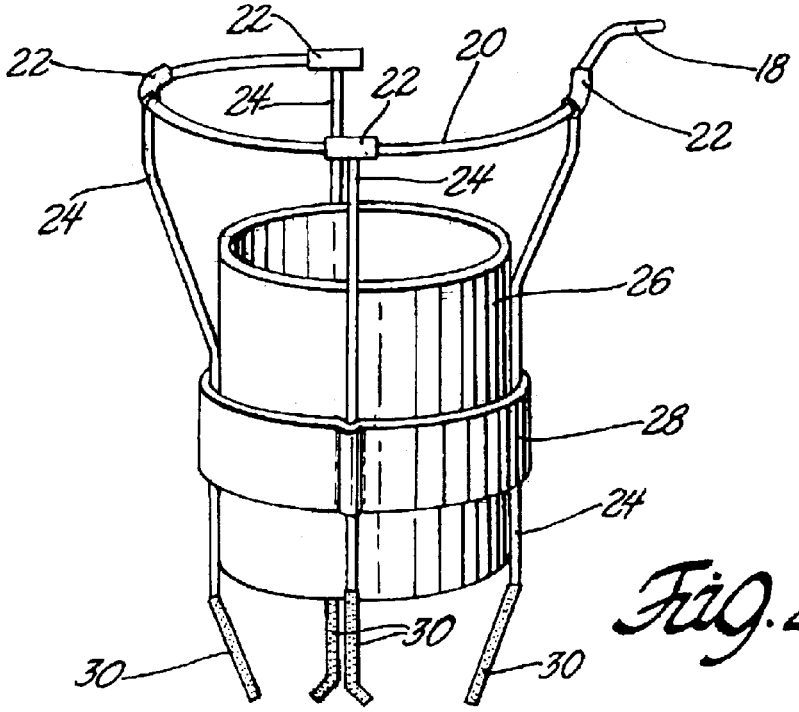
FIG. 2 is an enlarged view of gas flow apparatus for introducing bubbles into a melt of molten metal in the apparatus of FIG. 1.

As best seen in FIG. 2, the four descending stainless steel tubes 24 are secured with metal strap 28 to the outer surface of a relatively thin wall, hollow ceramic cylinder 26. Ceramic cylinder 26 is inserted vertically into the top of furnace 12 through the top of ceramic crucible 14 to a position just above the surface of the molten metal 16. Cylinder 26 and tubes 24 are suspended by any suitable means not shown in FIG. 1. Tubes 24 each extend through the lower end of cylinder 26 to a distance of, e.g., six to eight inches below the surface of the molten metal 16. Thus, in this example, the argon gas flows down through four spaced tubes into the melt 16 of aluminum with its suspended silicon carbide particles. The immersed ends of tubes 24 are coated 30 (FIG. 2) with boron nitride for protection from the molten aluminum 16.

Argon gas leaves the submerged ends of tubes 24 as individual bubbles that rise to the top of the molten mass in the ceramic crucible, forming molten aluminum foam. There is no agitation of the bath other than as caused by the rising bubbles. The bubbles create a froth of aluminum alloy and suspended particles on the surface of the melt. The froth solidifies as metal foam 32 in the cooler region at the surface. And this foam tends to be lifted by the continual stream of rising argon bubbles. Soon after the beginning of argon flow it is necessary to lift the solidified foam from the surface.

Referring to FIG. 1, a cable 34 suspended over a pulley 36 above the crucible 14 and ceramic cylinder 26 is used to continually draw the solidified foam 32 up from the melt surface. A hook, or other suitable attachment element, on the end of cable is initially suspended just above the surface of melt. The hook is not seen in FIG. 1 because it is embedded in the ascending metal foam cylinder 32 and the bottom end of cable 34 is hidden by manifold 20. The initially formed foam solidifies around the hook and attaches to it. The cable is slowly pulled by motor 40 at the rate of formation of the foam. The continually formed foam cylinder 32 is gradually pulled up through the gas injection tube support cylinder 28 and manifold 20. The rate of drawing the cellular metal column 32 is suitably coordinated with the rate of foam formation to minimize unwanted compression or stretching of the foam.

The density of the foam depends upon the rate of bubble flow to the surface and the rate of foam removal from the surface. These variables can be determined experimentally to produce foam of uniform cell structure and desired density. If a low-density foam is be produced, for example, one to two percent of the density of the solid composite, the height of the foam will be many times the height of a liquid column of the same weight.

Example of Cellular Metal Preparation.

Two foamed structure types were prepared using the same alloy, an aluminum matrix composite containing 20% silicon carbide by volume (Duralcan F3S.20S). The alloy was maintained in a molten state, in the range of 620° C.–680° C. A relatively small laboratory furnace and crucible was employed and the sample size was approximately 3 kg of metal. With this amount of metal some cooling of the melt occurs during the foaming process which accounts for the temperature range.

Fine stainless steel tubes (1.6 mm outside dia.) were inserted around the inner circumference of the crucible until the exposed orifice of each tube was suspended 2–4 cm from the bottom of the crucible. Each stainless-steel tube was curved to accommodate the inner surface of the crucible, allow the exposed orifice to deeper into the crucible while still maintaining an approximately 2 cm separation between the exposed orifices. The length of each stainless steel tube was sufficient to extend approximately 20 cm into the molten metal and 40 cm above the molten metal. The tubes remain fixed to the sides of the crucible so as to avoid becoming entangled as the foam emerges from the center of the crucible. Foaming occurs when argon gas is injected into the molten metal through these tubes using gas pressures ranging from 50 to 100 psi. No stirring of the melt is employed as the gas is injected. Thus, the only agitation of the melt is caused by the rise of the bubbles. In this sense the generation of the cellular metal is considered a quiescent process.

The gas pressure controls the rate of foam formation and is adjusted to match the rate at which solidified foam is extracted. The cell size, and thus the density of the foam, is usually controlled by the initial choice of the orifice size of the stainless steel tubes. In the lower density foam samples, the orifice size was 0.010 inch dia., while the higher density foam was produced with an orifice size of 0.007 inch dia. In both cases, approximately 100 cm of columnar foam, 13 cm in dia., was produced in 30 min.

Commercially available foams produced from aluminum matrix composite containing 20% silicon carbide by volume (Duralcan F3S.20S) are also heated to temperatures just above their melt temperature, probably in the range 620° C.–680° C. The molten metal is agitated with a beater or impeller composed for four vanes or paddles that maintain a continuous turbulence within the molten metal. The gas is injected through an orifice at the outer edge of each of the vanes or paddles, allowing the rapid rotation of the impeller to break up and disperse the gas stream. The turbulent dispersal of the gas within the molten bath is characteristic of this manufacturing process, resulting the inhomogeneous cell structure and material density.

Cellular metals, particularly closed cell aluminum foams, are useful in lightweight structural and energy absorption applications. Closed cell aluminum foams exhibit a good stiffness-to-weight ratio in bending and good shear and fracture strength. Thus, they are useful in sandwich panels and other lightweight structures. Aluminum foams are also useful in energy absorption applications, like bumpers and other packaging applications because of the way they undergo plastic deformation.

Researchers have shown that in uniaxial compression, the stress-strain curve of a cellular metal structure is characterized by three parts. The foam first experiences an initial linear elastic regime at low stresses. In this regime the cell walls stretch and bend. The second part of the stress-strain curve plastic strain occurs at substantially constant stress (plateau regime). In the plateau regime the cells collapse. Finally, there is a densification regime in which the cell walls are compressed against each other at increasing stress. Closed cell aluminum foams made by the quiescent bubbling process of this invention have well defined and uniform cells. They absorb energy very effectively in the plateau regime.

The quiescent gas injection process of this invention, as described above, has been used to produce cellular aluminum alloy bodies of remarkably uniform cell structure and low density. For example, cellular bodies of Duralcan F3S.20S composition have been made at relative densities of one percent and two percent, respectively, of the density of the solid starting composite. By comparison, Cymat foams were available only at higher relative density, three to six percent or higher of the starting composite. Furthermore, the cellular structure of the Cymat commercial foams was not uniform. Comparative physical testing of the energy absorption properties of the subject cellular metal bodies (1 to 2% relative density) and the Cymat bodies (3 to $6^{+}$% relative density) was conducted. The uniform cell structure bodies made by the subject invention had better energy absorption properties in the plateau regime even though they weighed much less.

While the invention has been described in terms of illustrative examples it is apparent that other forms could readily be adapted by one skilled in the art. Accordingly, the scope of the invention is to be considered limited only by the following claims.

What is claimed is:

1. A method of making cellular metal with closed wall cells, said method comprising on a continuous basis introducing a flow of gas at a location below the surface of a bath of molten metal to produce one or more streams of distinct gas bubbles rising to the surface of the molten metal, said bath being quiescent except for said rising bubbles, the flow of said bubbles producing a closed wall cellular foam of said metal on the surface of said bath above said gas introduction location;

cooling said foam to solidify it as cellular metal; and withdrawing said cellular metal from the surface of said bath, the rate of withdrawal of said cellular metal being coordinated with the rate of flow of said gas to produce a column of said cellular metal.

2. A method as recited in claim 1 comprising introducing said gas flow through a nozzle of size and at a flow rate to produce a cellular metal of predetermined average cell size.

3. A method as recited in claim 1 in which said cellular metal is withdrawn upwardly from the surface of said bath through a mold defining a desired cross-section of said cellular metal.

4. A method as recited in claim 1 in which the specific density of said cellular metal is in the range of one to five percent.

5. A method as recited in claim 1 in which said metal is an aluminum alloy.

6. A method as recited in claim 1 in which said metal is an aluminum-silicon alloy.

7. A method as recited in claim 1 in which said metal is an aluminum alloy containing up to twenty percent by volume of refractory, foam stabilization particles.

8. A method as recited in claim 1 in which said metal is an aluminum-silicon alloy containing up to twenty percent by volume of refractory foam stabilization particles.

9. A method of making cellular metal of aluminum alloy with closed wall cells, said method comprising on a continuous basis introducing a flow of gas at a location below the surface of a bath of molten aluminum alloy containing up to twenty percent by volume of refractory foam stabilization particles to produce one or more streams of distinct gas bubbles rising to the surface of the molten metal, said bath being quiescent except for said rising bubbles, the flow of said bubbles producing a closed wall cellular foam of said metal on the surface of said bath above said gas introduction location;

cooling said foam to solidify it as cellular metal; and withdrawing said cellular metal from the surface of said bath, the rate of withdrawal of said foam being coordinated with the rate of flow of said gas to produce a column of said cellular metal.

10. A method as recited in claim 9 in which said metal is an aluminum-silicon alloy containing up to twenty percent by volume of refractory foam stabilization particles.

* * * * *